United States Patent [19]

Anderson

[11] 3,951,202

[45] Apr. 20, 1976

[54] AUTOMATIC CASTING MACHINE

[76] Inventor: Victor O. Anderson, 17250 S. Main, Gardena, Calif. 90247

[22] Filed: Apr. 18, 1973

[21] Appl. No.: 352,126

[52] U.S. Cl. ..... 164/262; 164/154; 164/303; 74/56; 74/57

[51] Int. Cl.[2] ..... B22D 17/20

[58] Field of Search ..... 74/56, 57; 164/131, 164/262, 265, 303, 325, 326, 347

[56] References Cited

UNITED STATES PATENTS

| | | | |
|---|---|---|---|
| 3,328,853 | 7/1967 | Pekrol | 164/347 X |
| 3,416,582 | 12/1968 | Jenks | 74/57 X |
| 3,547,181 | 12/1970 | Lewis | 164/265 |
| 3,661,490 | 5/1972 | Trueblood | 164/326 X |
| 3,672,437 | 6/1972 | Bennett | 164/265 |

FOREIGN PATENTS OR APPLICATIONS

| | | | |
|---|---|---|---|
| 1,073,157 | 1/1960 | Germany | 164/262 |

*Primary Examiner*—Roy Lake
*Assistant Examiner*—Paul A. Bell
*Attorney, Agent, or Firm*—Blakely, Sokoloff, Taylor & Zafman

[57] ABSTRACT

An automatic casting machine for automatically die casting and die trimming of zinc, aluminum, magnesium, lead or injection molding of parts and delivering the finished parts die trimmed free of flash and separated from the runners, gates and overflows into a finished parts receiver. The machine can be fabricated as a modification of a conventional die casting or injection molding machine, primarily by the addition of a centrally located indexing finger which becomes fastened to the sprew or bung upon casting or molding of the parts. On each opening and closing cycle of the mold the rotating indexing device rotates ninety degrees thereby rotating the spider from the casting or molding location to a series of additional stations which may include the sensing and cooling station to cool the casting, a punch and trim die station to deburr the casting and punch the finished part from the spider, and a spider ejection station, which in the case of a die casting machine may be disposed so as to automatically result in the return of the spiders to the pot.

17 Claims, 13 Drawing Figures

Fig. 1
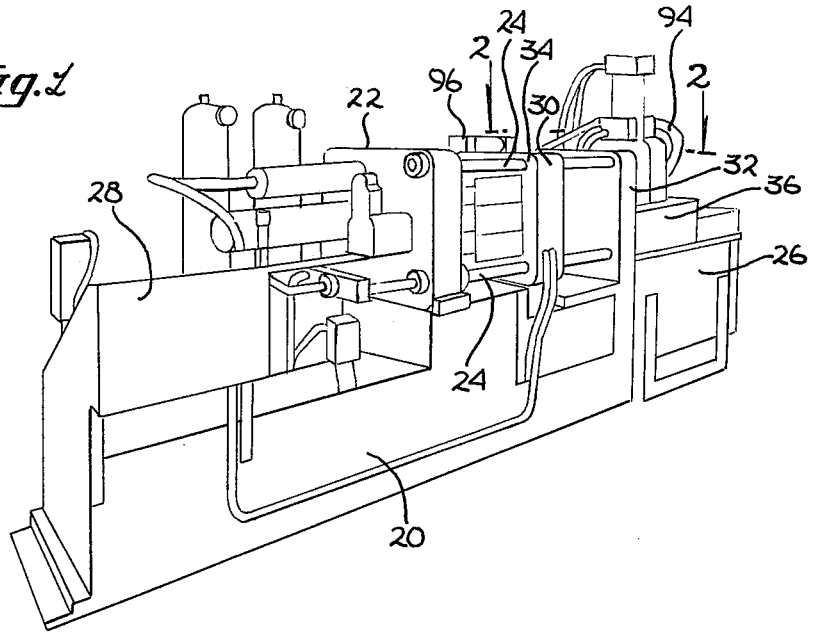
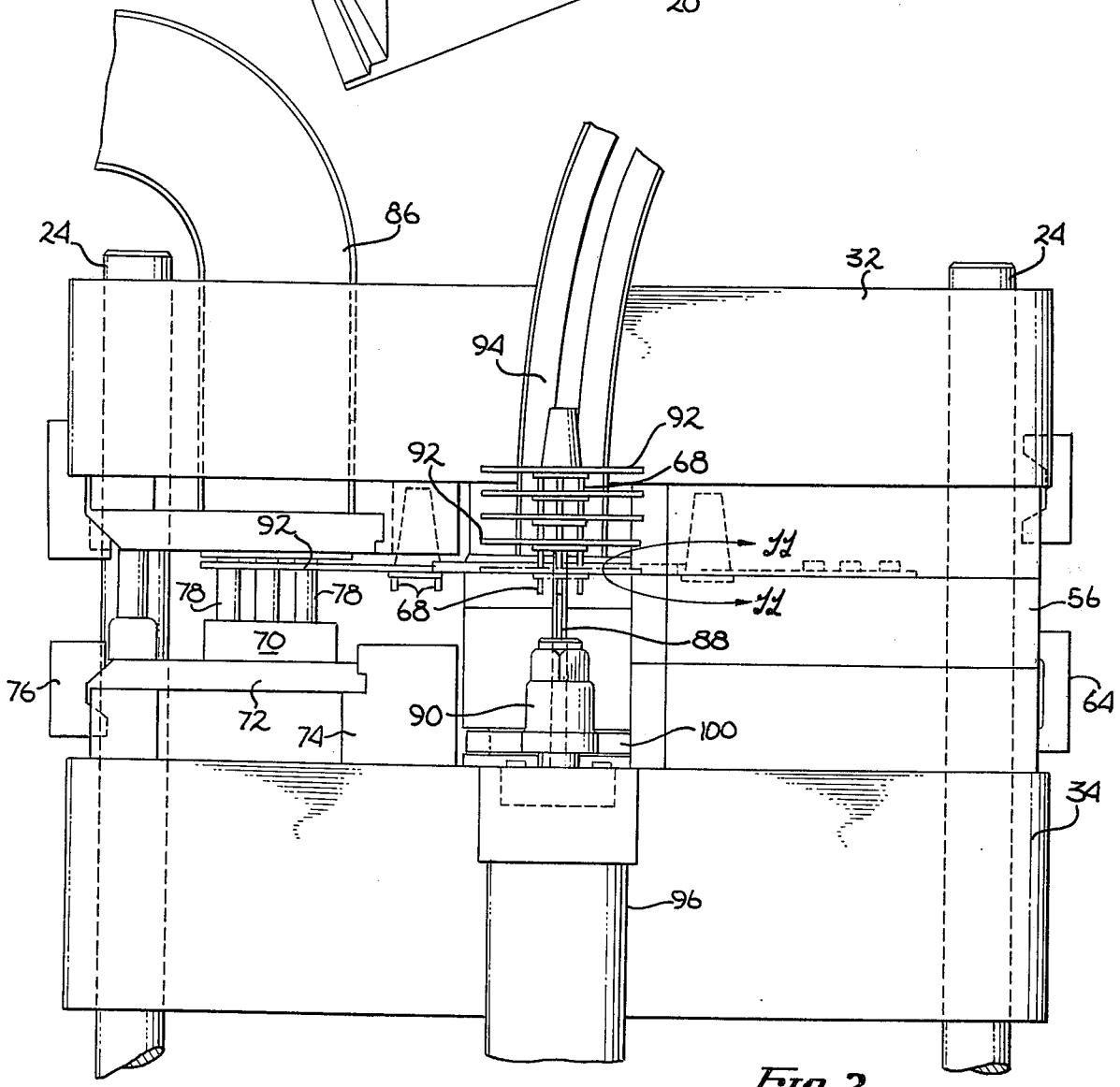
Fig. 2

Fig. 7
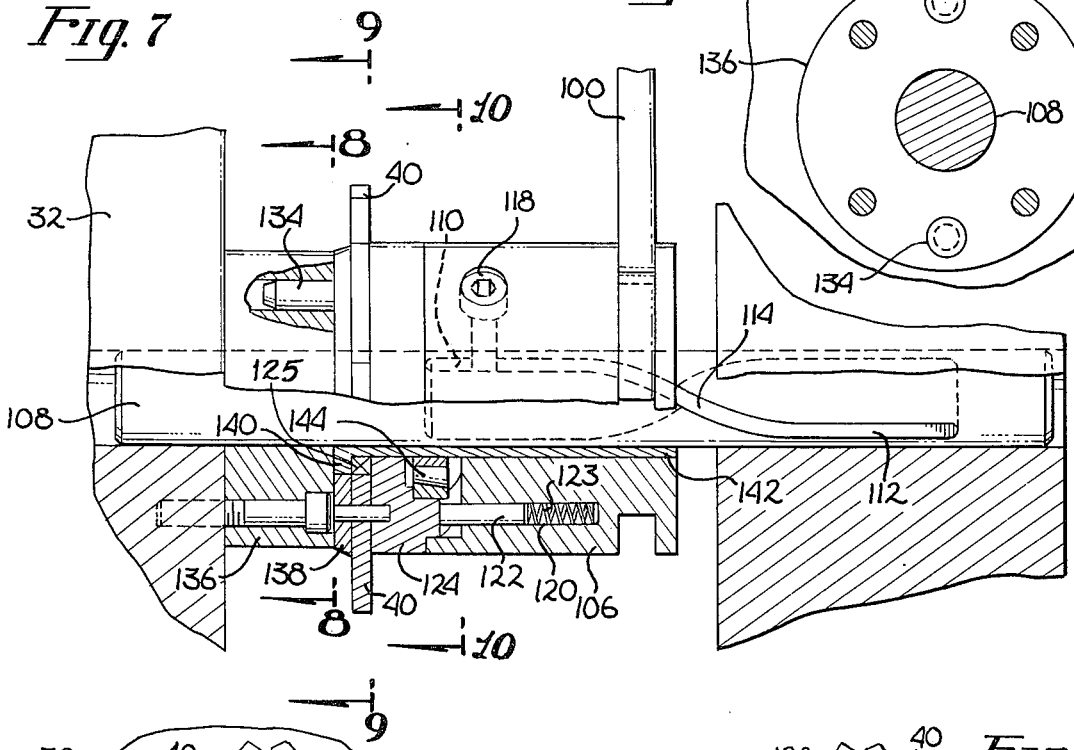
Fig. 8
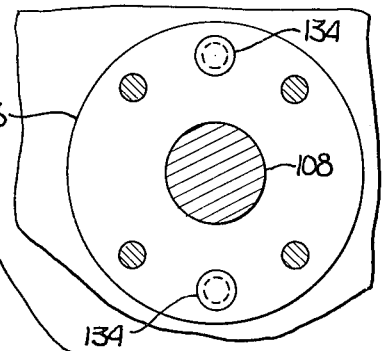
Fig. 9
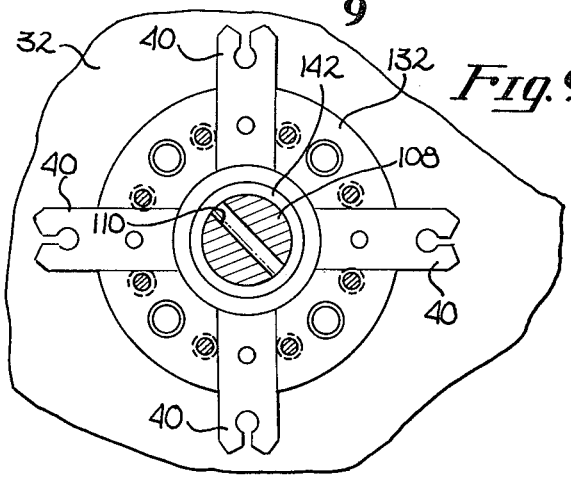
Fig. 10
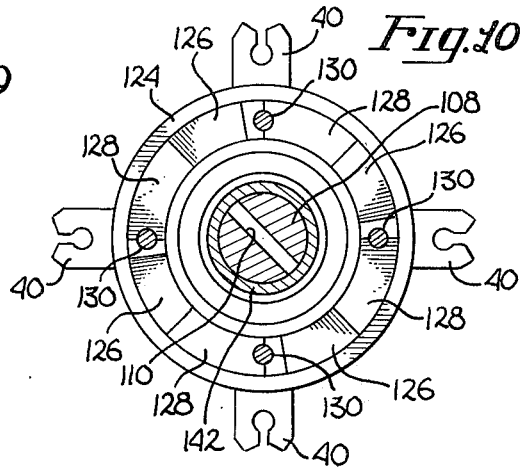
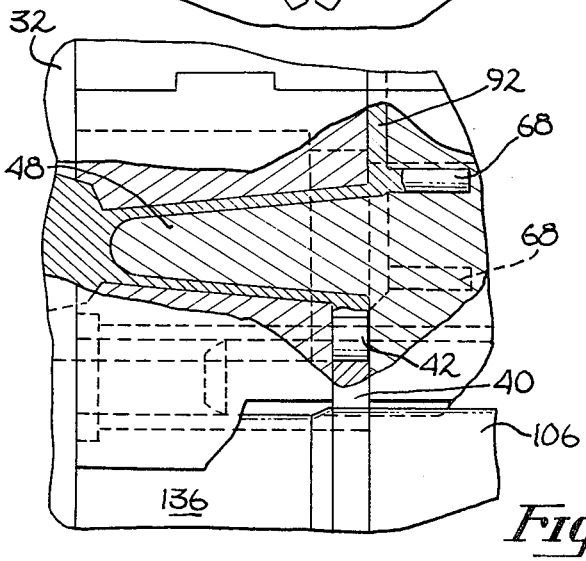
Fig. 11
Fig. 12a
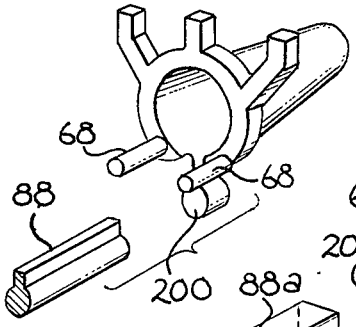
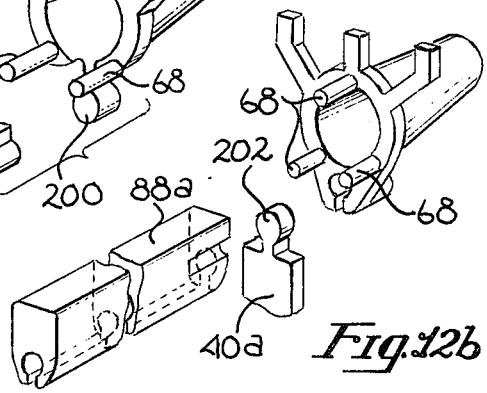
Fig. 12b

AUTOMATIC CASTING MACHINE

BACKGROUND OF THE INVENTION

1. Field of the Invention

This invention relates to casting and molding equipment and, particularly, to automatic equipment for die casting and injection molding.

2. Prior Art

Die casting and injection molding equipment is well known in prior art. This type of equipment is characterized by some form of metal mold, usually a simple two-piece mold with a stationary platen, a movable platen and an ejector plate. A means (pot) is provided for retaining molten metal or a heating chamber for plastic pellets of some form, with an injection means for injection of a pre-determined amount of metal or plastic into the mold under relatively high pressures so as to very quickly completely fill the mold before the material solidifies. After molding (e.g. injection) the mold will be left closed for a moment and, in some instances, a coolant circulated through the mold for cooling purposes. The movable platen is then withdrawn and the molded parts are removed therefrom.

In die casting equipment molten metal of the appropriate temperature is maintained in a pot and a piston-cylinder arrangement, typically hydraulically driven, is used for injection. In injection molding machines other types of injectors are also known, such as, by way of example, leadscrew injectors. In any event, while certain details of the equipment vary from manufacturer to manufacturer and from die casting equipment to injection molding epuipment, these differences in design are well known and are relevant to the present invention only in that the present invention is not limited to the specific apparatus disclosed herein, but is readily usable in other types of die casting equipment and in injection molding equipment. Thus, in the remainder of this Prior Art Section and for purposes of explanation of a preferred embodiment, the present invention will be described with respect to a specific die casting machine, it being understood that this is for purposes of explanation only, and the invention is not to be so limited thereby.

The operating cycle of a typical die casting machine is first, the closing of the mold; second, the injection of the molten metal; third, the cooling and solidifying of the molten metal while the mold remains closed; fourth, the opening of the mold, typically with the molded parts and the spider designed to hang up on the moving part; and, five, the removal of the spider and molded parts as one piece, perhaps after the moving portion has engaged injection pins to eject the casting from the movable mold half. This cycle has been utilized for a great number of years with very little change, though individual details of the equipment, of course, have been improved over that time.

Once the casting is removed from the die casting machine, the individual parts had to be removed from the spider and any flash that occurred also removed from the parts. For some parts this might be accomplished by hand, though for repeatability of results, and particularly for larger parts, some form of punch and die is used to accurately separate all the finished parts from the spider whereupon the spider is returned to a breakdown pot to be remelted. Often the casting as removed from the die casting is dipped in water to aid in the cooling thereof and to facilitate handling and die trimming.

There are a number of problems and disadvantages with the prior art die casting machines, which are now becoming fairly severe. Typically, an operator wearing an asbestos glove reached between the mold halves to receive the casting and remove it therefrom for cooling and later placement in the punch press. Obviously, this operation required an operator and also required not only a punch and die, but a complete punch press-type of machine to operate the die trimming. At the present time safety standards are being imposed which prevent an operator from reaching between the mold halves in a die casting machine, or, for that matter, between the punch and die of the punch press. Thus, if the operation is to be done manually as before, long tongs must be used to handle the casting, (e.g. to reach between the mold halves and the punch and die) thereby making handling difficult and tending to slow down the operation.

As an intermediate solution to the problem, equipment is commercially available for mounting on or adjacent to the die casting machine and referencing with respect thereto so as to automatically reach between the mold halves when the mold is open to remove the casting and to transport the casting to the cooling stage or through a cooling stage or through a cooling stage to a punch press. In essence, this equipment merely performs the function of a mechanical man, thereby replacing the operator with the tongs to meet the safety requirements and to provide a more automated operation. This solution, however, has its limitations in that in addition to the die casting machine and the punch press, the mechanical man is also required, the cost of which may be greater than the cost of the punch press and substantial even in comparison to the cost of the die casting machine. It is a complicated machine having its own maintenance and reliability problems. It is a machine which must be set up for each specific casting and in relation to the physical location of the die casting machine and punch press. Even then when all three machines are operating as desired the spiders must be accumulated at the punch press and manually returned to the pot to be remelted and transported back to the die casting machine.

In U.S. Pat. No. 3,328,853 entitled Die Casting and Trimming Machine, there is disclosed a machine in which a gate is coupled to a turntable rotatable about one tie bar of the machine so as to rotate the casting outward from the platens to a separate punch press machanism for trimming the castings. In U.S. Pat. No. 3,547,181 a multiaxis turntable is provided between the platens for performing additional operations between the platens. This apparatus uses a transverse slide mechanism for stripping the spider from the turntable and uses a separate turntable drive independent of the platen drive to provide the desired turntable motion.

Thus, there is a need for automatic die casting equipment and automatic injection molding equipment which will automatically cast or mold parts, shear or punch the parts from the spider for delivery at a desired location and perform such further operations as predetermined cooling of the casting and eventual return of the spider to the pot of the die casting machine through the use of simplified structure and a minimum of independent drive mechanisms.

BRIEF SUMMARY OF THE INVENTION

An automatic casting machine for automatically die casting and die trimming of zinc, aluminum, magnesium, lead or injection molding of parts and delivering the finished parts die trimmed free of flash and separated from the runners, gates and overflows into a finished parts receiver. The machine can be fabricated as a modification of a conventional die casting or injection molding machine, primarily by the addition of a centrally located indexing finger which becomes fastened to the sprew or bung upon casting or molding of the parts. On each opening and closing cycle of the mold the rotating indexing device rotates ninety degrees thereby rotating the spider from the casting or molding location to a series of additional stations which may include the sensing and cooling station to cool and casting, a punch and trim die station to deburr the casting and punch the finished part from the spider, and a spider ejection station, which in the case of a die casting machine may be disposed so as to automatically result in the return of the spiders to the pot. The control equipment for the die casting machine, as well as other standard features of such machines such as automatic application of mold release, etc. may be the same as are now commercially available. The only additional control required is the means for controlling the position of the spider by an indexing assembly to cooperate with the ejection of the casting from the moving mold half and for supporting castings in a free-standing position between the two mold halves as indexing occurs. Preferably, some means of sensing each casting on the spider at the second station is desirable as this allows the interruption of the machine operation if one of the castings has hung up in the mold. In the specific embodiment disclosed herein such sensing is done as an integral part of the casting cycle at the cooling station.

Brief Description of the Drawings

FIG. 1 is a perspective view of a typical die casting machine incorporating the present invention.

FIG. 2 is a top view of a portion of the machine of FIG. 1 taken along lines 2—2 of that figure.

FIG. 7 is a partial cross-section taken along lines 7—7 of FIG. 6.

FIG. 8 is a cross-section taken along lines 8—8 of FIG. 7.

FIG. 9 is a cross-section taken along lines 9—9 of FIG. 7.

FIG. 10 is a cross-section taken along lines 10—10 of FIG. 7.

FIG. 11 is a partial cross-section taken along lines 11—11 of FIG. 2 on an expanded scale.

FIG. 12*a* is an illustration of one means of providing spider connection to the finger-like member 40 and a punch suitable for removing the spider therefrom.

FIG. 12*b* is an alternate embodiment for the spider connection to a finger-like member.

DETAILED DESCRIPTION OF THE INVENTION

Figure 3:
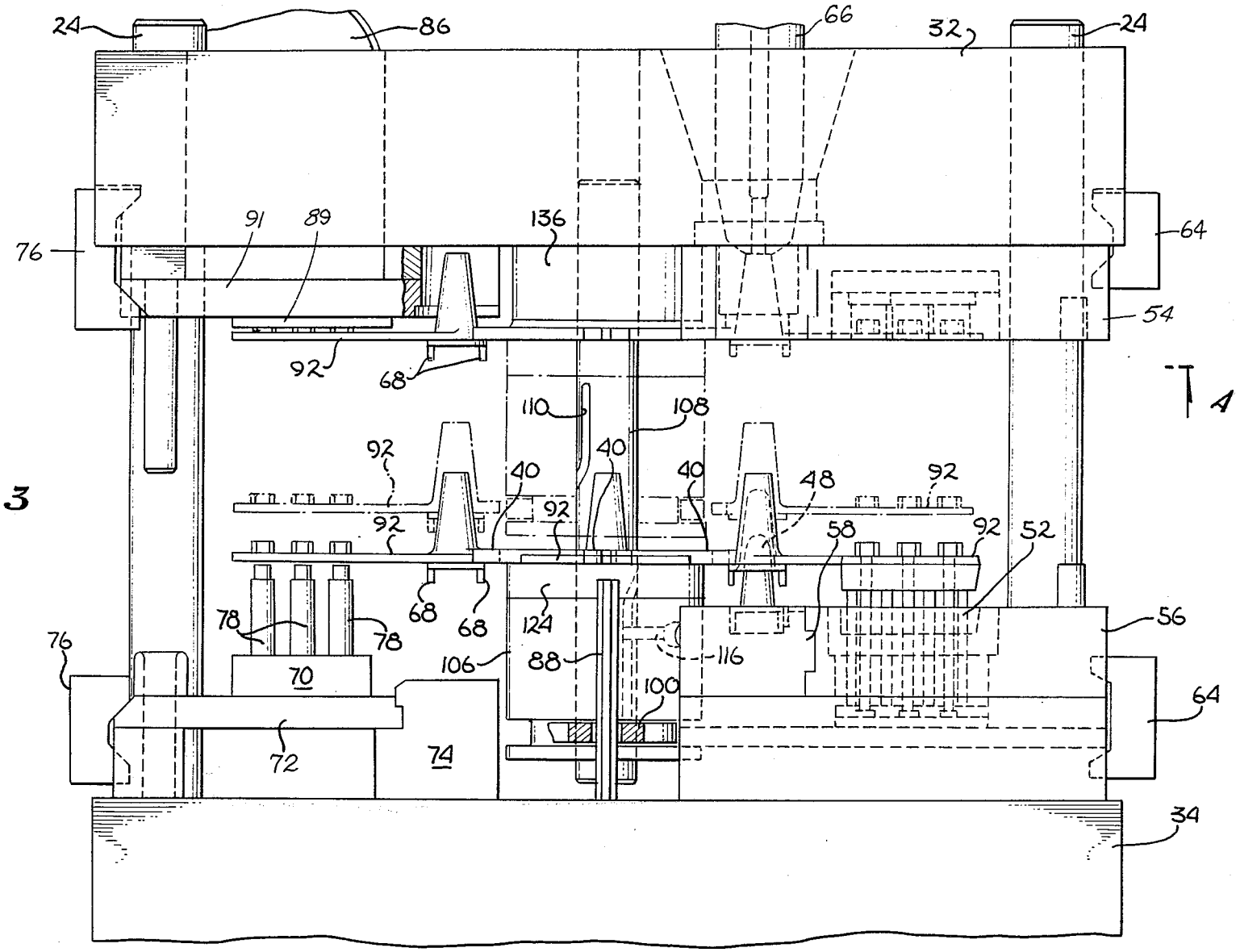
FIG. 3 is the top view similar to the view of FIGURE- taken on an expanded scale to illustrate further features of the invention.

First referring to FIG. 1, a perspective view of a die casting machine incorporating the present invention may be seen. This machine is a modification of the Harvill Model 254-Z Hot Chamber Die Casting Machine, manufactured by H. L. Harvill Mfg. Co., P.O. Box 777, Corona, Calif. The modifications to the basic machine are, first, the widening of the frame 20 and tie bar supports 22 so that the tie bars 24 have a greater horizontal separation than in the standard 254-Z machine (preferably approximately twice the original horizontal spacing). The second modification is comprised of a number of changes to the widened machine in accordance with the present invention, the details of which will hereinafter be described.

The various individual components of the die casting machine, such as by way of example the pot 26, may be the standard components as commercially available on the 254-Z machine and consequently, except as may be relevant to the description of the present invention, will not be described in detail as already being well known in the prior art. Thus the basic control circuitry and time clocks, generally located in the control box 28 and control box 30, are also well known in the prior art as part of the 254-Z machine, through these components as hereinafter described are modified for use in conjunction with the present invention.

The machine of FIG. 1 is provided with a stationary hot platen 32 passing through tie bars 24 to a tie bar support 22. Mounted between the tie bar support 22 and movable platen 34 is a hydraulic cylinder of conventional design (not shown in FIG. 1) for encouraging movable platen 34 into the open and closed position and holding the platen closed against the pressure of the injector, generally located in the region 36.

Figure 4:
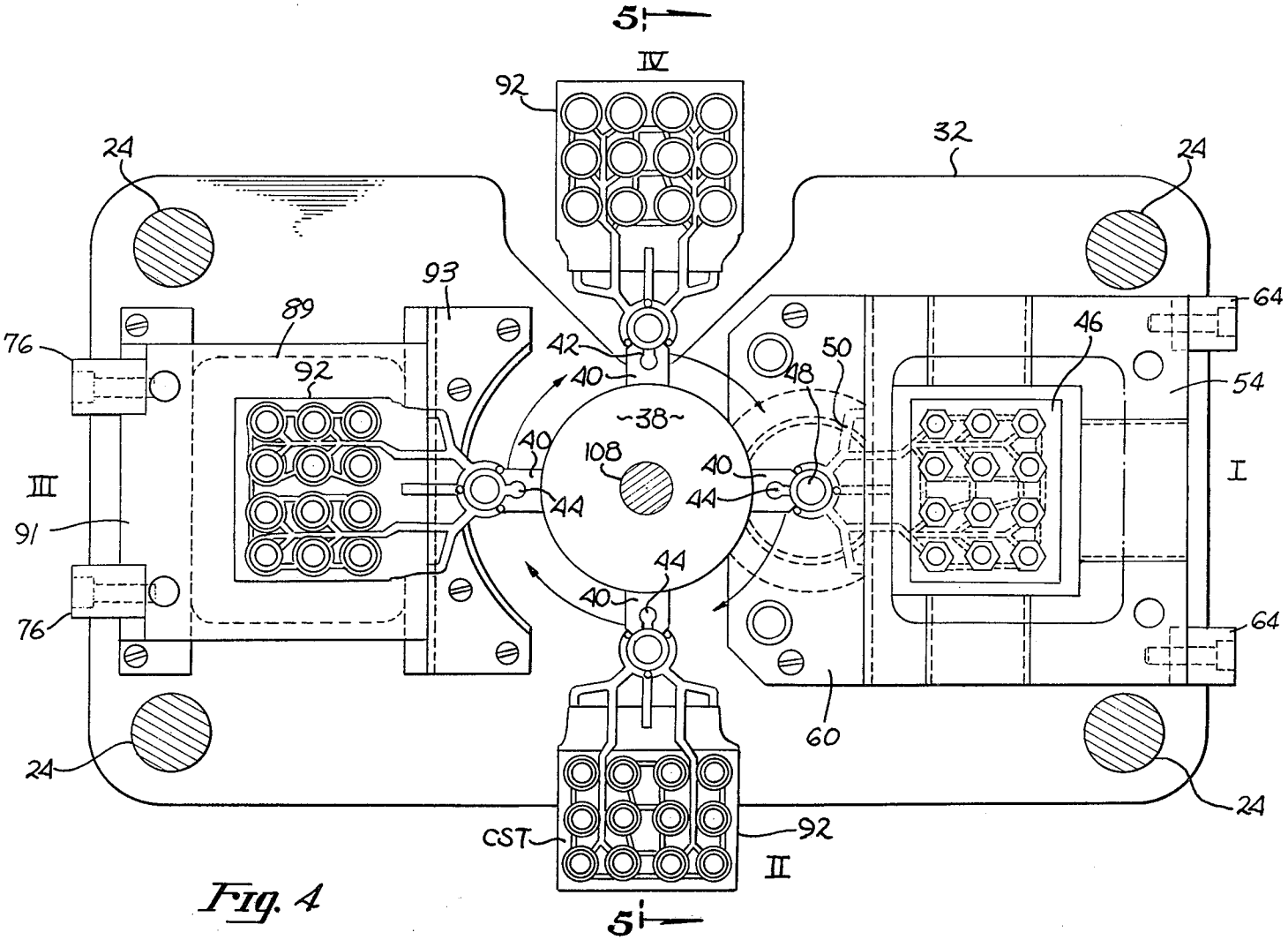
FIG. 4 is a cross-sectional view taken along lines 4—4 of FIG. 3.

The basic operating cycle of the machine may be outlined with the aid of FIG. 4. This figure is a cross-section taken along lines 4—4 of FIG. 3 and may be considered as a view looking toward the hot platen. A rotating support member 38 supports four finger-like members 40 at 90° positions about its periphery. The finger-like members are characterized as having an opening 42 in the ends thereof leading into an enlarged area 44 so as to form a cavity in which part of the casting may be formed to cause the retention of the casting by the finger. The first station, indicated by (I) is the station holding the fixed mold half 46 (the moving mold half not being observable in this view). The injector injects the molten metal through an opening 48 which fills the cavity defined in part by mold 46, a semi-permanent portion of a standard spider 50, (with movable mold half) the region of the injector opening 48, and in addition, the enlarged area 44 of the finger-like member 40 aligned with opening 48 and the mold halves.

When the mold opens the casting will be generally supported by the moving mold half and will be ejected therefrom by some ejection means, typically by a bump-out ejection system which will push the casting free of the moving mold half so that the casting will be free-standing between the two halves when the mold is fully open (the rotating support member 38 will move in cooperation with the casting so that the casting remains affixed to finger 40, and the general plane of the casting will remain perpendicular to the tie bars 24).

Prior to the complete closing of the two mold halves, the rotating support member 38 will rotate 98° in the direction indicated so that the casting, indicated by the letters CST, projects downward as shown at station II. At the same time the finger-like member 40 which had been directed vertically upward comes into position to receive the new casting metal at station I (the casting spider having previously been stripped off of the finger-like member 40 prior to that rotation). As shall subsequently be seen, when the mold closes again a spray of water is directed toward the casting at station II, thereby cooling the casting at station II while a new casting is cast at station I.

In the subsequent opening of the mold halves the rotating support member 38 again rotates 98°, thereby rotating the casting from station II to the position indicated as station III. When the mold closes again and the rotating support member 38 moves downward against the stationary platen the casting at station III is guided into an approximately located die assembly, with the final closing of the mold halves also forcing a punch on the moving platen into cooperative disposition with the die to push the finished parts out of the spider. Ideally, the punches are provided with some form of solid drive and some spring loaded member so that once the parts are punched free of the spider the spring loaded member may effectively eject the parts through the die for direction into a finished parts bin.

As the fourth and final step in the sequence, the mold is again opened and the rotating support member 38 again rotated ninety-degrees, rotating the spider (less the parts which were removed at station III) to the vertically upward position shown as station IV. Thus on the subsequent closing of the mold halves, a stripper punch engages the portion of the casting protruding into opening 42 and region 44 of the finger-like member 40 to strip the spider from the finger member. A chute is provided (not shown in FIG. 4) to receive the spiders and to direct the spiders back into the pot for re-melting, thereby completing the automatic cycle.

From the foregoing explanation it may be seen that the four operations in the preferred embodiment accomplished at the four stations are:

1. molding
2. cooling
3. punching the finished parts from the spider
4. removal of the spider from the rotating support member for return to the pot. The forces required for punching the parts out of the spider and for forcing the spider off the finger-like member are relatively small in comparison with the closing and locking pressure used to overcome the molten metal injection pressure, and further, these forces occur during the closing of the mold halves, whereas the pressurforces of the molten metal occur only after closing and during injection. Therefore, the incorporation of operations such as the punching operation do not detract from the load capacity of the basic machine, but instead make maximum use of the fact that the casting is necessarily very accurately located by the mold halves so as to be readily referenced from that point by such means as the rotating support member so as to be movable to the subsequent stations, and particularly the punch stations for accurate location of the casting with respect to the punch and die so that the automatic die trimming may be readily achieved. It will be noted that removal of the casting from the mold halves, as well as the trimming operation are totally automatic and do not require the reaching between the platens by either an operator or a mechanical device.

Figure 6:
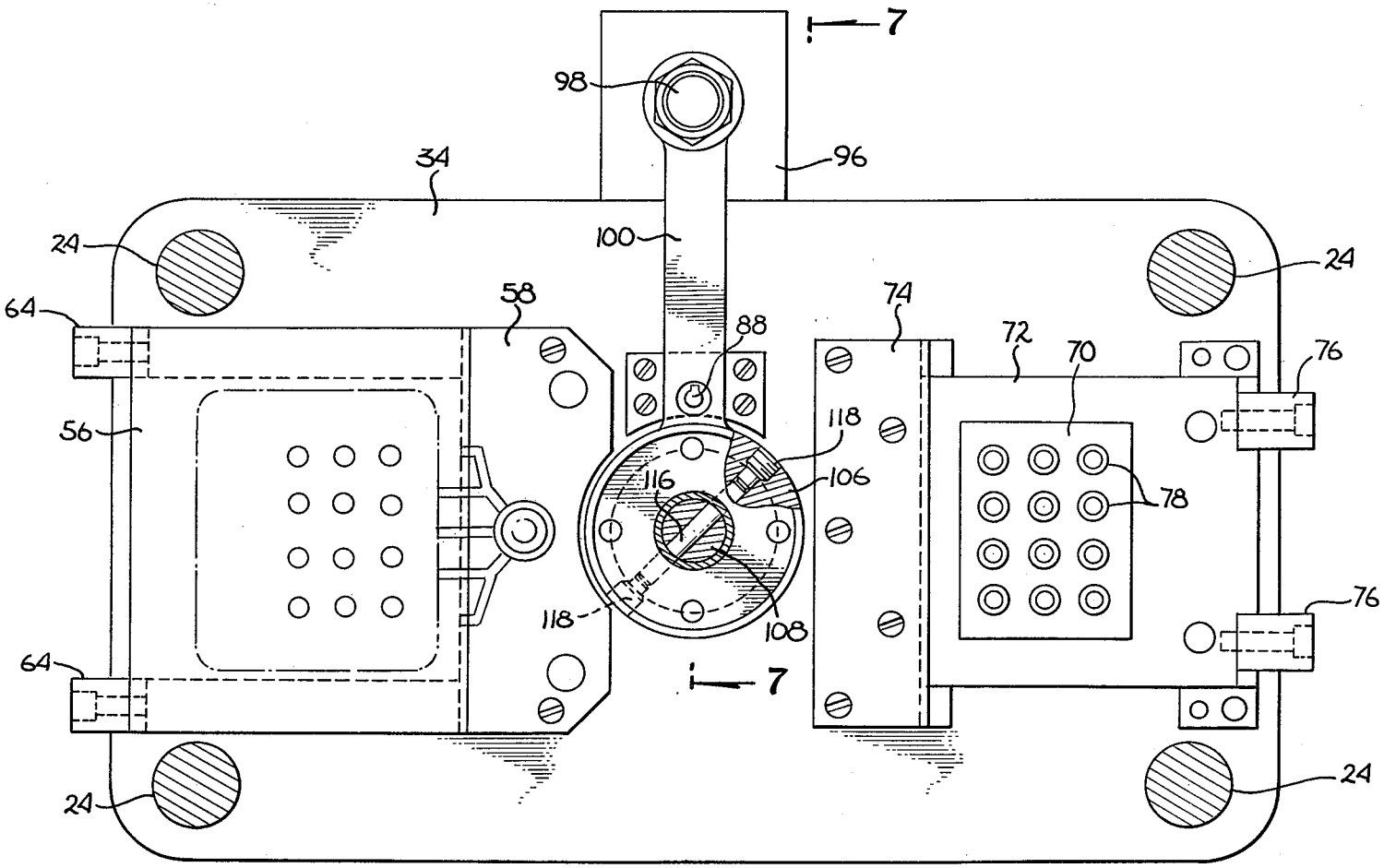
FIG. 6 is a cross-section taken along lines 6—6 of FIG. 6.

Having now generally outlined the operation of the die casting machine of the present invention, details of each of the four stations of the preferred embodiment shall now be described. Thus, referring to FIGS. 3, 4 and 6, details of station (I) may be seen. The stationary half of the mold 46 as well as the moving half of the mold 52 are each supported in respective ones of standard mold bases 54 and 56, which in turn are indexed with respect to the stationary platen 32 and the moving platen 34 by index members 60 and 58 and blocks 64 respectively. The injector member 66 cooperates with a protruding member 48 and a fixed portion 50 of the spider (on the moving mold half) to inject molten metal into the mold cavity when the mold is closed. The mold bases, the mounting thereof and the injector may be standard components normally used with injection molding machines of this type and will not generally be further described herein. One modification is required, however, in at least one of the mold bases. Thus, in the preferred embodiments, the stationary platen mold base is relieved in the area of a finger-like member 40, so that the finger-like members may form an innermost mold closure member in a relief of the stationary mold half so that the casting becomes attached to the finger-like member 40 by the filling of the opening 44 therein. Obviously, the mold base receiving the finger-like member 40 may be either of the mold bases, or in fact may be both mold bases (the pins 63 formed as an integral part of the casting are additional ejector pins to eject the screw from member 68 as is well known in the prior art, and further serve to prevent rotation of the casting as shall subsequently be described). Thus it may be seen that in the station (I), substantially standard mold bases accommodating removable mold halves cooperate in conjunction with a standard injector assembly to provide a conventional die casting. There is also provided an indexing means to form a portion of the mold cavity in such a manner as to result in the mechanical attachment in some manner of the casting to the index assembly (rotating support member) so that the index assembly may support the casting when ejected free of the mold halves for rotation to the next operation station.

Figure 5:
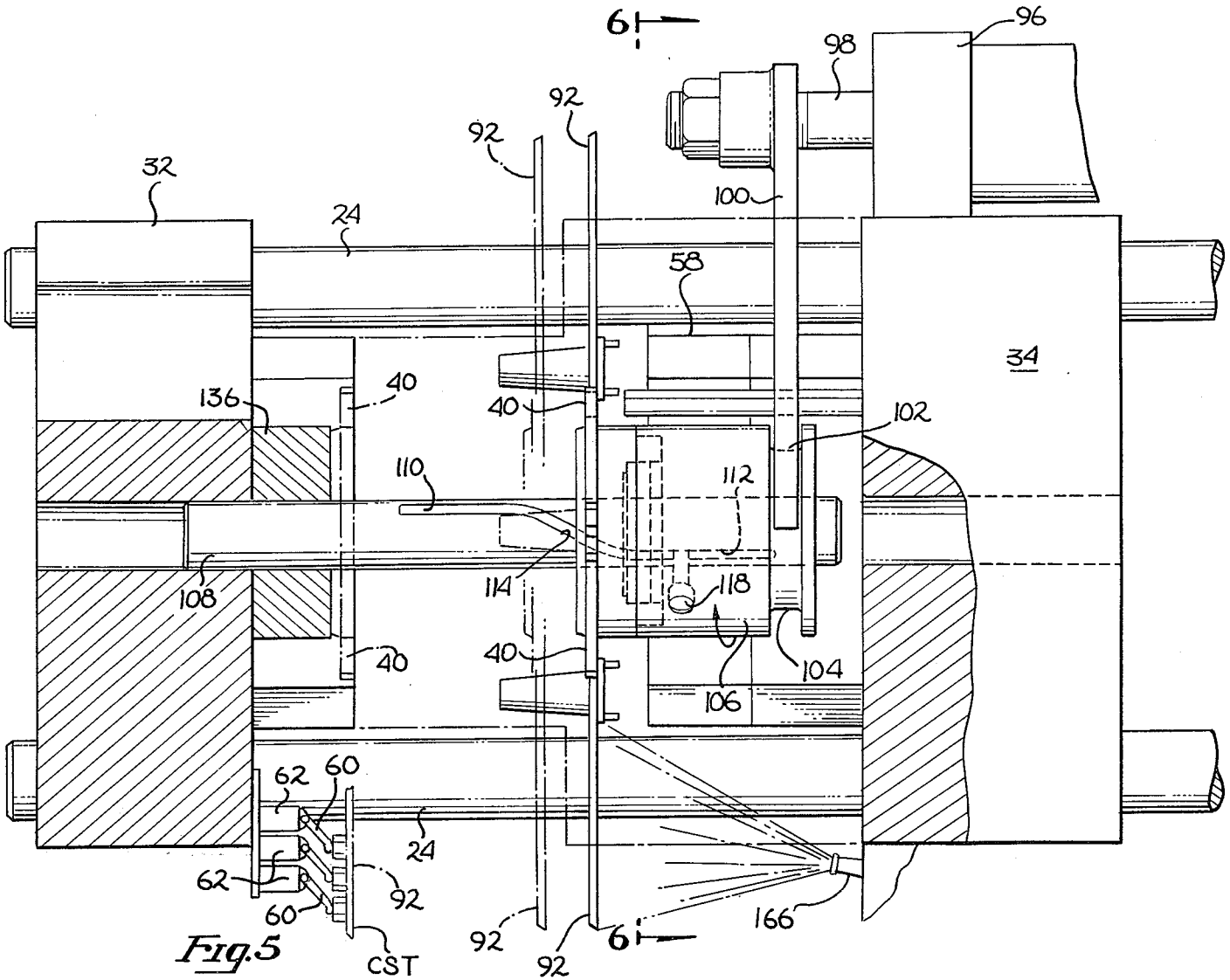
FIG. 5 is a side-view of the mold region of the casting machine of FIG. 1.

After casting, a rotating support member is rotated 90° so that the casting just formed is projecting downward at station (II). It shall be subsequently seen that the rotating support member 38, in part, follows the motion of the moving platen and indexes before returning to its position against the stationary platen. Accordingly, casting CST is rotated downward before moving into its closest proximity to the stationary platen 32. Thus, the final movement of the casting is linear to the left as seen in FIG. 5, thereby engaging a plurality of feeler levers 60, activating switch members 62, which are electrically coupled in series to actuate a solenoid valve, thereby turning on a spray 166 to spray an air-collant mixture onto the casting. A plurality of levers 60, each actuating a switch 62, is used for the following reasons: occasionally on a multi-cavity mold one of the cast parts will hang up on the mold and may cause damage to the mold or die casting machine if the molds close when the part is so hung up, particularly if the part is hung up in a shifted or cocked position. Accordingly, levers 60 are arranged so that each lever may sense the position of one of the parts in the casting so that all switches may be actuated only if none of the parts have hung up in the mold. The switches 62 are coupled to the master control unit so that if all switches are not actuated when the casting reaches the position shown at station (II) in FIG. 5, the operating cycle will be terminated, thereby preventing final closure of the mold halves and possible damage thereto. The spray apparatus 166 may be of conventional construction, and preferably with conventional apparatus of the type providing a mist-like spray to give the desired cooling without an undue thermal shock to the casting. The switches may be of the contact or non-contact type, with mercury switches being used in the preferred embodiment.

The Station (III) is the punch station with the die 89 (FIGS. 3 and 4) mounted on a die support member 91 located by a permanent locating member 93, and blocks 76 bolted to the stationary platen. It will be noted that for convenience the mounting of the die 89 is substantially the same as the mounting for the mold halves. In the preferred embodiment, the die 89 is mounted with respect to the die support member 91 by a combination of bolting and pinning. In this manner, the die 89 may be roughly aligned by design and may be finally aligned by adjustment of its position with respect to the shrinkage and positioning of the castings in station (III) as rotated to that station by the rotating support member. Therefore, once properly located, the die 89 may be drilled and pinned to the die support member 91 so as to be removable and replaceable without difficulty and without subsequent realignment problems. There is also provided on the moving platen a punch set 78 mounted on a punch support member 70 by block 72 and member 74 (see FIG. 3). Here again, bolting and pinning are desirable so that the punch at 78 may be removed and replaced without difficulty of realignment. The punch set 78 and die 89 may be of conventional design, with the punches being of the punch through type. Thus, upon final closure of the mold halves the punch set 78 cooperates with die 89 to punch the parts out of the spider and through die 70 onto a chute 86 on which the parts slide into a finished parts receiver (bin, box, or other receiving means such as by way of example, a conveyor and like). The chute 86 as well as the relative position of the punch and die set when the mold is closed may be seen in FIG. 2.

At station (IV), the finger-like member 40 is projecting upward and supporting the empty spider in an upward direction. A punch member 88 rigidly affixed to the moving platen 34 by assembly 90 is configured and disposed so as to pass through the opening 44 in the finger-like member 40 at station (IV) upon the closure of the mold. Accordingly, punch 88 will force the spider 92 out of the finger-like member 40 and onto a track of guide 94. In the embodiment shown, the guide 94 is an open channel-like member loosely defining a continuation of the opening 44 in the finger-like member 40 so that the spiders 92 are maintained in side by side disposition and forced along the guide 94 by the repetitive injection of additional spider members into the guide by punch 88. The guide terminates generally over the pot, so that the spider-like members fall one at a time into the pot for re-melting. In this manner, the automatic return of the spiders is provided with minimal temperature perturbation in the pot by the uniform rate of return of the spider members to the pot. The pins 68 forming an integral part of the spider aid in maintaining the spiders in separation so that they do not tend to hang up on each other so as to fall in groups into the pot on a random basis.

As an alternate to the channel member 94, it has been found that a generally V-shaped trough may serve the same purpose without requiring as accurate alignment of the trough with the finger-like members and the punch 88. Similarly, for some castings, it has been found desirable to provide a means above the pot to assure that the spiders fall one by one into the pot, though in general this should not be required in most cases.

Having now described the detail of each of the various stations, the details of the rotating support member 38 and the mechanism coupled thereto to provide indexing shall now be described. There is provided on the top of the moving platen 34 a hydraulic cylinder 96 having a piston rod 98 fastened to arm 100 (see FIGS. 5, 6 and 7, and generally FIG. 1). The arm 100 has a lower portion 102 in the form of an arc or fork-like member engaging recess 104 in member 106. Member 106, in turn, is slidably supported by a shaft 108 fastened to the stationary platen 32. Member 108 is generally a cylindrical or pin-like member and is provided with a diametrically oriented slot therethrough having a first portion 110, a second portion 112 angularly rotated with respect to portion 110 by 90°, and a third intermediate portion 114 angling between the portions 110 and 112 (thereby forming a lead screw means). Member 106 has a follower pin 116 trapped between set screws 118 and passing through the slot in shaft 108, so that the angular orientation of member 106 is determined by the angular orientation of the slot at the axial position of pin 116 (thereby forming a lead screw follower means). Accordingly, it may be seen that member 106 will rotate through an angle of 90° when moving between the positions shown in FIGS. 5 and 7.

Member 106 has four equally spaced holes 120 (FIG. 7) each containing a pin 122 backed up by a coil spring 123 for elastically encouraging the pin 122 against the mating surface of member 124. The front face of this member may best be seen in FIG. 10 which in effect is an end view of the member. Member 124 has four regions 126 of a first elevation and four sloping regions 128 sloping downward from regions 126 to define four engaging surfaces 130 to intercept the pins 122. Thus it may be seen that member 106 may be rotated in a first direction with respect to member 124 but when rotated in the opposite direction pins 122 will engage surfaces 130 to force simultaneous rotation of members 124 and 106. There is thus provided a ratchet means of free-wheeling assembly between these two members to allow relative rotation in one direction but not in the other direction.

Member 124 has pinned thereto the finger-like members 40, with members 132 completing the full circular shape. There is also provided a plurality of locating pins 134 having tapered outward projecting ends thereon for sliding within cooperatively disposed locating holes in member 136 bolted to the stationary platen (see FIG. 8 also). Other parts of the assembly include a circular member 138 serving both to provide greater rigidity to the mounting of the finger-like members 40 and segment 132, and to provide a spacer for the flange 140 of a bearing member 142 retaining members 124 and 106 in relative axial disposition (member 125 is a thrust bearing member). There is also provided a roller bearing 144 for radial support of the assembly on member 124 when member 106 is rotated with respect thereto.

Having now described the details of the indexing assembly, the operating cycle of the casting machine of the present invention may be more fully described, with the details of the mechanism being illustrated in the various figures and the arrangement of stations shown generally in FIG. 4. Assume as a starting point that the mold is closed. The injector is then actuated to fill the mold, sprue, etc. Following a short delay to allow solidification of the casting, the moving platen 34 is withdrawn in the conventional manner to open the mold. During the withdrawal, the upper cylinderr 96 is not actuated so that the member 100 withdraws the assembly comprising member 106 and member 124 supporting the finger-like members 40. In this regard the casting is designed to hang up on the moving mold half so that the entire assembly and casting are withdrawn. Member 106 rotates 90° with respect to member 124 by the combined action of the slot portion 114 and the free-wheeling ratchet effect of spring loaded pins 122 on the cooperatively disposed face of member 124. The 90° rotation indexes pins 122 at new positions against surfaces 130 (see FIG. 10) so that upon return of member 106 to the closed position member 124 will be forced in rotation thereby. (It should be noted that since the casting hangs up on the moving portion of the mold, and in addition the pins 68 on the casting provide positive rotary indexing of the casting to the moving mold half, the coupling of member 124 through finger-like members 40 to the casting prevents the rotation of member 106 from inducing any similar rotation of member 124.)

In the last portion of the withdrawal of the moving platen, the ejector pins eject the casting from the moving mold half. During ejection there is relative motion between the casting and the moving mold half, and accordingly cylinder 96 is actuated in cooperation with the ejection means so that the position on the finger-like members 40 is made to coincide with the ejected casting. Upon ejection cylinder 96 continues to be actuated for an instant so that the casting is supported in a free-standing position between the moving mold half and the stationary mold half as shown in phantom in FIG. 3. In this position the casting at the punch station, as well as the other stations are also supported free and clear of the apparatus at the respective station so that rotation of all castings about the axis of pin 108 may be accomplished.

The next step in the sequence is the subsequent closing of the mold. During the first portion of the closing, that is, the moving of the movable platen, cylinder 96 is not actuated. Accordingly, member 106 is rotated 90° by the portion of the slot 114, thereby rotating the finger-like members, and the castings and spider thereon, 90° to the next stations. Sufficient travel of the moving platen is provided so that this rotation may be accomplished before the castings are inserted into the die at station III, before the finger-like member is located into the mold half, etc. The final portion of travel of the member supporting the finger-like members is linear to seat the casting into the die, to seat the finger-like members between the mold halves, to actuate the spray at the cooling station, etc. (Actuation of the spray may also be accomplished by timing devices rather than the levers shown, though the levers or some equivalent means is desirable to provide the safety feature of sensing the absence of a part, thereby indicating the occurrence of a finished part hang up in the mold). When the assembly on member 124 bottoms against the structure of the stationary platen, cylinder 96 is actuated, this time being withdrawn to allow the final motion of the moving platen into the mold closed position. This results in the punching out of the finished parts at station III, the punching of the empty spider off of the finger-like member at station IV and the closing of the mold at station I ready for the injection of the casting material.

It may be seen from the above that while a number of operations have been automatically accomplished in accordacne with the described cycle, all controls for controlling the motion of the moving platen for operating the injector, etc. may be in accordance with well known techniques, and in fact the equipment commerically available with the 254-Z machine has been used for this purpose without modification. The only addition thereto which is required is the addition of a control valve, preferably a solenoid operated control valve, to control the actuation of the upper cylinder 96, and some means for coordinating the action of the upper cylinder with the motion of the moving platen. This may be accomplished by an addition to the timing means for the overall operating cycle to control the upper cylinder in cooperation with the motion of the moving platen, or may be controlled by a first switch sensing engagement and actuation of the ejector means, and a second switch sensing the arrival of the assembly on member 124 at a position immediately adjacent to the stationary platen during the closing of the mold.

There has been described herein an automatic casting machine which performs various functions to provide finished parts without operator intervention or the intervention of separate transport and punch press means. In a broad sense the invention comprises the addition of an indexing means, a portion of which may cooperate with the mold to result in a connection of the indexing means to a casting for indexing to the additional stations, which may include a cooling station, a punch press station and a stripper station to remove the empty spider therefrom. In the embodiment described herein the protruding member 200 (see FIG. 12*a*) is formed as an integral part of the spider which locks the casting to the indexing means through the finger-like member 40. For this type of protruding member the punch 88 may be in the form shown in that figure. As an alternate, as shown in FIG. 12*b*, the finger-like members may be as shown in FIG. 12*b*, with the finger-like members 40*a* having a flared region 202 around which the casting is formed. This configuration has certain advantages in that the casting shrinks around the finger-like member to better secure the casting thereto. For this configuration the punch may be in the form of the punch 88*a*. Other configurations may include a pair of adjacent spaced apart protrusions on each finger-like member similar to the protrusion 202 so as to provide even greater rigidity on the connection of the casting to the finger-like member and to better couple the angular motion of the finger-like member to the casting.

In the specific embodiment disclosed the specific structure for the indexing mechanism, as well as the arrangement of specific stations, has been described in detail, as an illustration of the advantages and flexibility of the invention. Obviously other operations must be performed at any of the stations, such as the drilling, tapping, etc. of a casting prior to its removal from the spider, and a different number of stations may be used as desired. While the preferred embodiment involves an enlargement of the frame of a conventional casting machine, the increase in cost thereof is not great, as all support equipment, etc. may be identical to that used with a standard machine. Similarly, other indexing methods, such as by way of example, a gear motor drive, etc. may be used if desired. Thus while the invention has been disclosed and described with respect to a preferred embodiment thereof, it will be understood by those skilled in the art that various changes in form and detail may be made therein without departing from the spirit and scope of the invention.

I claim:

1. For use in die casting and injection molding machines having a stationary platen and a moving platen, an improved indexing mechanism comprising:

a stationary first index means coupled to said stationary platen;

a second index means coupled to said moving platen, said second index means movable between first and second linear positions along the axis of said first index means, said first and second index means being for rotating said second index means through a predetermined angle with respect to said first index means upon the motion of said second index means from said first linear position to said second linear position and back to said first linear position, said second index means having a plurality of equally spaced casting engaging members each for engaging and temporarily retaining a portion of a casting;

a first die member coupled to said stationary platen and a second die member coupled to said moving platen, said first and second die members and each of said casting engaging means being cooperative for forming a closed mold cavity;

a casting spider removal means disposed at a predetermined angle around said first index means from said die members, said castings engaging said casting engaging members so as to be forceably removed therefrom in a direction parallel to the direction of movement of said moving platen, said removal means including a member coupled to said moving platen and disposed to engage said casting adjacent one of said casting engaging members to forceably remove said casting spider therefrom upon closure of the mold.

2. The indexing mechanism of claim 1 wherein said first index means is a lead screw means and said second index means is a lead screw follower means.

3. The indexing mechanism of claim 1 wherein said second index means is coupled to said moving platen through a linear actuator movable in the direction of motion of said moving platen between first and second positions with respect thereto.

4. The indexing mechanism of claim 1 further comprised of a coolant spray means and a plurality of sensing means disposed a predetermined angle around said first index means from said die members, said sensing means being electrically coupled in series and disposed so as to be actuated by contact with castings supported by one of said casting engaging means when another of said casting engaging means and said first and second die members form a closed mold cavity, said sensing means being coupled to said spray means and being operative to collectively cause said spray means to spray coolant on said castings.

5. The indexing mechanism of claim 4 wherein said sensing means are switches electrically coupled in series.

6. The indexing mechanism of claim 5 wherein said switches are electrically coupled to the machine control and are operative to prevent full closure of said mold cavity upon the absence of one casting adjacent one of said sensing means.

7. The mechanism of claim 1 further comprised of a chute means for receiving said casting spiders on removal from said casting engaging members, said chute means being a means for guiding said casting spiders back to the pot of the machine.

8. In a molding apparatus having a stationary platen, a moving platen, and a set of tie bars coupled to said stationary platen and slideably passing through said moving platen, the improvement comprising:

a lead screw means parallel to and disposed within the pattern defined by said set of tie bars, said lead screw means being coupled to said stationary platen and having a first and third portion each substantially without lead, and an intermediate second portion having substantial lead and extending through a predetermined angle, a lead screw follower means disposed on said lead screw means and slideably engaging one of said first, second and third portions of said lead screw means for determining the angular position of said lead screw follower means, an indexing member coupled to said lead screw follower means through a ratchet means for allowing rotation of said indexing member in a first direction with respect to said lead screw follower and resisting relative rotation in a second direction, said indexing member having a plurality of equally spaced casting engaging members each for engaging and temporarily retaining a portion of a casting, said lead screw follower means and said indexing member forming an indexing assembly, a reference member rotatably coupling said indexing assembly, said reference member being coupled to said molding apparatus through an actuator, and a casting spider removal means disposed adjacent said lead screw means, said castings engaging said casting engaging members so as to be forceably removed therefrom in a direction parallel to the direction of movement of said moving platen, said removal means including a member coupled to said moving platen and disposed to engage said casting adjacent one of said casting engaging members to forceably remove said casting spider therefrom upon closure of the mold.

9. The improvement of claim 8 wherein said actuator is coupled to said moving platen.

10. The mechanism of claim 8 further comprised of a chute means for receiving said casting spiders on removal from said casting engaging members, said chute means being a means for guiding said casting spiders back to the pot of the machine.

11. The improvement of claim 8 further comprised of a coolant spray means and a plurality of sensing means disposed adjacent said lead screw means, said sensing means being electrically coupled in series and disposed so as to be actuated by contact with castings supported by one of said casting engaging means when another of said casting engaging means and first and second die members form a closed mold cavity, said sensing means being coupled to said spray means and being operative to collectively cause said spray means to spray coolant on said castings.

12. The improvement of claim 11 wherein said sensing means are switches electrically coupled in series.

13. The improvement of claim 12 wherein said switches are electrically coupled to the machine control and are operative to prevent full closure of said mold cavity upon the absence of one casting adjacent one of said sensing means.

14. In a die casting or molding apparatus having a stationary platen, a moving platen, and a set of tie bars coupled to said stationary platen and slideably passing through said moving platen, the improvement comprising:

a lead screw means parallel to and disposed within the pattern defined by said set of tie bars, said lead screw means being coupled to said stationary platen and having a first and third portion each substantially without lead, and an intermediate second portion having substantial lead and extending through a predetermined angle, a lead screw follower means disposed on said lead screw means and slideably engaging one of said first, second and third portions of said lead screw means for determining the angular position of said lead screw follower means, an indexing member coupled to said lead screw follower means through a ratchet means for allowing rotation of said indexing member in a first direction with respect to said lead screw follower and resisting relative rotation in a second direction, said indexing member having a plurality of equally spaced casting engaging members each for engaging and temporarily retaining a portion of a casting, said lead screw follower means and said indexing member forming an indexing assembly, a reference member rotatably coupling said indexing assembly, said reference member being coupled to said molding apparatus through an actuator, a casting spider removal means disposed adjacent said lead screw means, said castings engaging said casting engaging members so as to be forceably removed therefrom in a direction parallel to the direction of movement of said moving platen, said removal means including a member coupled to said moving platen and disposed to engage said casting adjacent one of said casting engaging members to forceably remove said casting spider therefrom upon closure of the mold; and a punch and die means disposed adjacent said lead screw means, said punch and die means being a means for punching castings from a spider upon movement of said moving platen to said stationary platen.

15. The apparatus of claim 14 further comprised of a plurality of sensing means disposed adjacent said lead screw means, said sensing means being electrically coupled in series and disposed so as to be actuated by contact with castings supported by one of said casting engaging members when another of said casting engaging members and mold dies on said platens form a closed mold cavity, said sensing means being a means for interrupting the operation of said apparatus upon failure to sense the presence of castings at a predetermined stage of operation of said apparatus.

16. The apparatus of claim 15 further comprised of a coolant spray means adjacent said sensing means for spraying coolant onto said casings.

17. The apparatus of claim 15 wherein said mold dies, said sensing means, said punch and die means and said spider removal means are disposed in 90° increments about said lead screw means.

* * * * *